US007980434B2

(12) United States Patent
Gouldson

(10) Patent No.: US 7,980,434 B2
(45) Date of Patent: Jul. 19, 2011

(54) INSIDE WRAP AROUND GARMENT HANGER

(75) Inventor: Stanley F. Gouldson, Northport, NY (US)

(73) Assignee: Spotless Plastics, Ltd., Moorabbin, Victoria (AU)

( * ) Notice: Subject to any disclaimer, the term of this patent is extended or adjusted under 35 U.S.C. 154(b) by 318 days.

(21) Appl. No.: 12/198,204

(22) Filed: Aug. 26, 2008

(65) Prior Publication Data

US 2010/0051655 A1 Mar. 4, 2010

(51) Int. Cl.
*A41D 27/22* (2006.01)

(52) U.S. Cl. ..... 223/91; 223/96

(58) Field of Classification Search ..... 223/88, 223/91, 85, 90, 93, 96; D6/319, 326
See application file for complete search history.

(56) References Cited

U.S. PATENT DOCUMENTS

| | | | | | |
|---|---|---|---|---|---|
| 2,518,098 | A | * | 8/1950 | Thrush | 223/96 |
| D164,710 | S | * | 10/1951 | Perry | D6/319 |
| 3,464,605 | A | * | 9/1969 | Apel | 223/96 |
| 4,828,155 | A | | 5/1989 | Louw | |
| D305,834 | S | * | 2/1990 | DeVito | D6/326 |
| D305,835 | S | * | 2/1990 | DeVito | D6/326 |
| D327,580 | S | * | 7/1992 | Fildan | D6/326 |
| 5,632,423 | A | | 5/1997 | Louw | |
| 6,000,588 | A | * | 12/1999 | Kolton et al. | 223/88 |
| 6,250,523 | B1 | * | 6/2001 | Louw | 223/96 |
| 6,675,997 | B1 | * | 1/2004 | Gouldson et al. | 223/89 |
| D505,019 | S | * | 5/2005 | Gosselin et al. | D6/326 |
| 6,892,910 | B2 | * | 5/2005 | Capuano et al. | 223/96 |
| D569,632 | S | * | 5/2008 | Singleton | D6/326 |
| 2004/0222252 | A1 | * | 11/2004 | Gouldson et al. | 223/85 |

* cited by examiner

*Primary Examiner* — Gary L. Welch
*Assistant Examiner* — Nathan E Durham
(74) *Attorney, Agent, or Firm* — Scully, Scott, Murphy & Presser, P.C.

(57) ABSTRACT

The present invention relates generally to molded plastic garment hangers. Garment hangers of this type may be simply constructed as molded plastic structures incorporating a hook adapted to be suspended from a suitable support, such as a garment display rack or the like. The garment hanger has a plurality of elongated body members extending in opposite directions from the hook so as to facilitate a garment to be suspended therefrom. The opposite or distal ends of the elongated body members typically have vertical members attached thereto, and a first set of garment clips formed on the vertical members to enable the attachment of various kinds of garments thereto. The vertical members also have a second set of garment clips formed on the opposite side of the vertical member to permit the garment straps to be secured.

7 Claims, 3 Drawing Sheets

INSIDE WRAP AROUND GARMENT HANGER

FIELD OF INVENTION

The present invention relates generally to molded plastic garment hangers as are widely used for the purpose of shipping and displaying garments. More particularly, the present invention relates to a garment hanger including at least two vertical garment retaining clips for securely holding a garment.

DESCRIPTION OF RELATED ART

A wide variety of molded plastic garment hangers with garment clips are presently known. U.S. Pat. No. 5,632,423 discloses a garment hanger having plural garment retaining clips on the distal ends of the arm, with improvements to the design of the clip, which was previously described in U.S. Pat. No. 4,828,155. One of the improvements described in this patent is the addition of a second garment retaining clip which engages straps of a garment to be hung from the hanger. The second garment retaining clip is intended to prevent the strap of an undergarment or bathing suit from hanging down in an unsightly manner.

Additionally, a number of other garment clip designs are known in the art for retaining undergarment straps. However, none provide a second vertical garment retaining clip disposed on an inner surface of a vertical member, wherein the vertical member is substantially perpendicular to the garment hanger arms, and wherein the second vertical garment retaining clip is vertically disposed.

Therefore, a garment hanger with a plurality of vertical garment retaining clips is needed that can hold the straps of garments neatly and on an opposite side of a vertical member than a plurality of vertical garment retaining clips that hold the garments.

SUMMARY OF THE INVENTION

According to the present invention, a garment hanger having an improved garment retaining clip configuration at opposite ends thereof is provided to securely retain a garment to prevent it from accidentally dislodging therefrom. Moreover, the improved garment retaining clip configuration is designed to avoid breakage of the clips, and to prevent straps of an undergarment or bathing suit from hanging down in an unsightly manner. The present invention solves this problem by providing an improved garment hanger having a vertical garment retaining clip that can hold the straps of a garment neatly and on the opposite side of a vertical member than a vertical garment retaining clip that holds the garment.

In accordance with one aspect of the present invention, a molded plastic garment hanger is provided. The hanger includes a hook member and a plurality of elongated body members. At lease one of the elongated body members is connected to the hook member. The hanger further includes a pair of generally parallel vertical members vertically disposed and integrally formed with each elongated body member. The pair of vertical members is substantially perpendicular to each elongated body member and connected with a first end and a second end of each elongated body member. The hanger further includes a plurality of first vertical garment retaining clips disposed outwardly from an outer surface of each vertical member. The plurality of first vertical garment retaining clips comprises a first support member connected to the vertical member and a first cantilever mount connecting the first support member to a second support member. The second support member extends from the first support member in a direction that is vertically opposed from the first cantilever mount. The first vertical garment retaining clip further comprises a first mouth defined by the second support member and the vertical member for guiding a garment into the first vertical garment retaining clip. With this arrangement, as a garment is inserted into the first garment retaining clip, the compound movement of the first and second support members results in the garment receiving channel of the clip first opening to allow the garment to enter, and then closing to securely retain the garment therein.

The hanger further includes a second vertical garment retaining clip disposed outwardly from an inner surface of the vertical member. The second vertical garment retaining clip comprises an inner support member vertically extending from the vertical member. The second vertical garment retaining clip further comprises a second cantilever mount connecting the inner support member to the vertical member and a second mouth defined by the inner support member and the vertical member for guiding a garment strap into the second vertical garment retaining clip.

Optionally, the present invention includes a plurality of stacked vertical garment retaining clips disposed outwardly from the inner surface and the outer surface of the vertical member for securing a series of garments, and is therefore not limited to only a first and second clip.

In accordance with another aspect of the present invention, a garment hanger, including a vertically disposed hook member and a first elongated body member and a second elongated body member, is provided. The first and second elongated body members are horizontally disposed, with the first elongated body member being integrally molded to the hook member. The hanger also includes a pair of generally parallel vertical members vertically disposed and integrally molded to each elongated body member. Each vertical member is substantially perpendicular to each elongated body member and is connected with a first end and a second end of each elongated body member. Furthermore, a first vertical garment retaining clip is disposed outwardly from an outer surface of each vertical member. The first vertical garment retaining clip includes a first support member vertically extending from each vertical member and a first cantilever mount connecting the first support member to a second support member. The second support member extends from the first support member in a direction that is vertically opposed from the cantilever mount. According to this configuration, a first mouth is defined by the second support member and each vertical member for guiding a garment into the first vertical garment retaining clip.

The hanger further includes a second vertical garment retaining clip integrally molded to each vertical member and disposed outwardly from an inner surface of each vertical member. The second vertical garment retaining clip includes an inner support member vertically extending from each vertical member and a second cantilever mount connecting the inner support member to each vertical member. According to this configuration, a second mouth is defined by the inner support member and each vertical member for guiding a garment strap into the second vertical garment retaining clip.

Pursuant to the present invention, the garment receiving channels defined by the first and second vertical garment retaining clips proceed from a bottom opening of the garment receiving channel, upwardly and inwardly towards the hook member to a top garment retaining position. The radial difference between the bottom opening and the top garment retaining position is approximately 0.125 inches, such that as a garment is inserted fully into the garment retaining clip, the width of the garment shrinks approximately ⅛ inch at each end of the garment hanger. This also means that the width of the garment must be expanded or stretched ¼ inch, considering the expansion at both ends, to remove the garment from the garment retaining clip, which deters accidental dislodgement of the garment therefrom.

In greater detail, the first vertical garment retaining clip includes a stiffening rib extending along the first and second support members to provide a relatively stiff and inflexible clip. Moreover, the second vertical garment retaining clip includes a stiffening rib extending along the inner support member to provide a relatively stiff and inflexible clip.

BRIEF DESCRIPTION OF THE DRAWINGS

These and other features, advantages and benefits of the present application will be made apparent with reference to the following detailed description and accompanying figures, wherein like reference numerals refer to like features across the several views, and wherein.

DETAILED DESCRIPTION OF THE INVENTION

Figure 1:
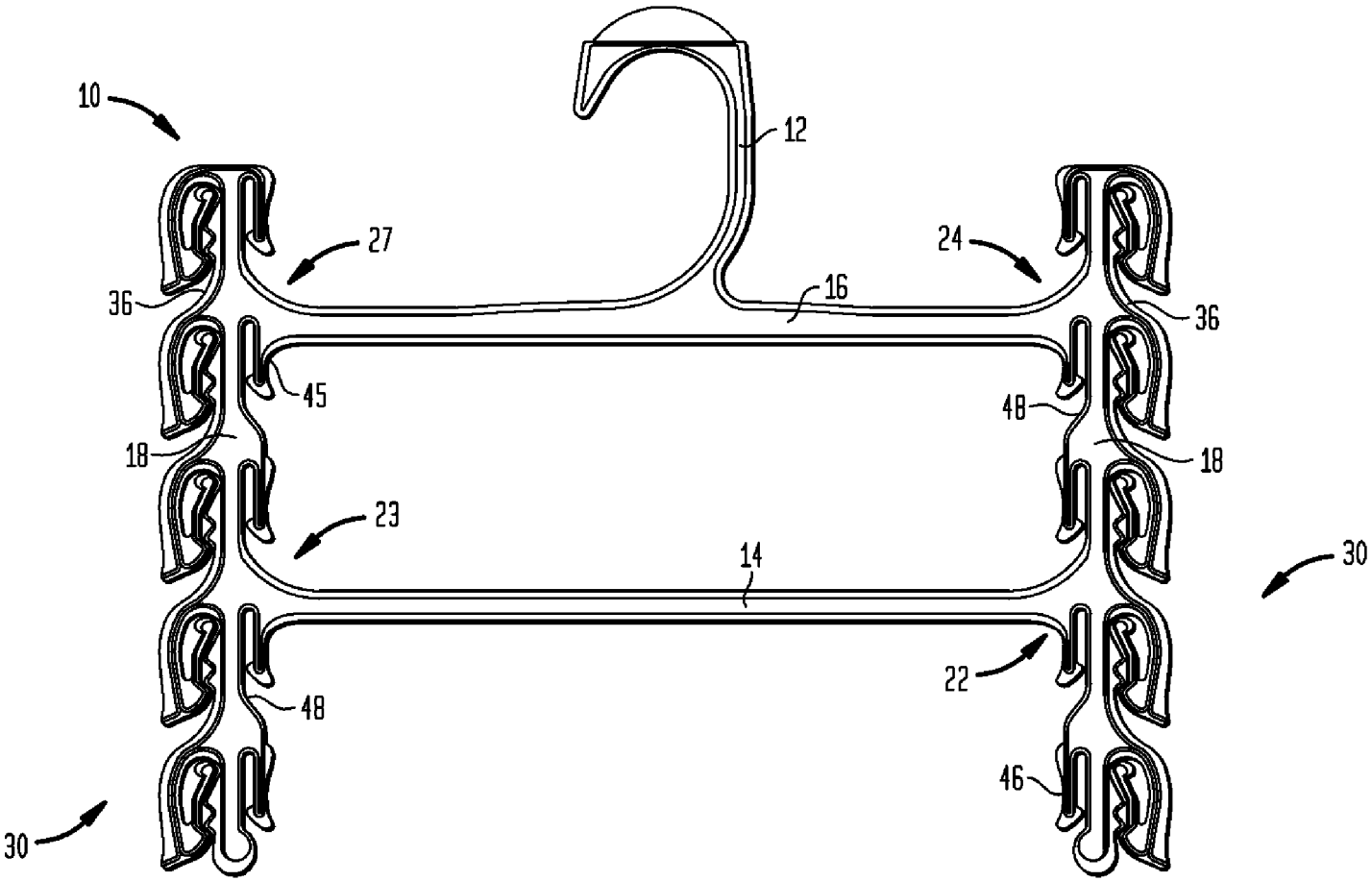
FIG. 1 is a front elevation view of a molded plastic garment hanger in accordance with an exemplary embodiment of the present invention.
Figure 2:
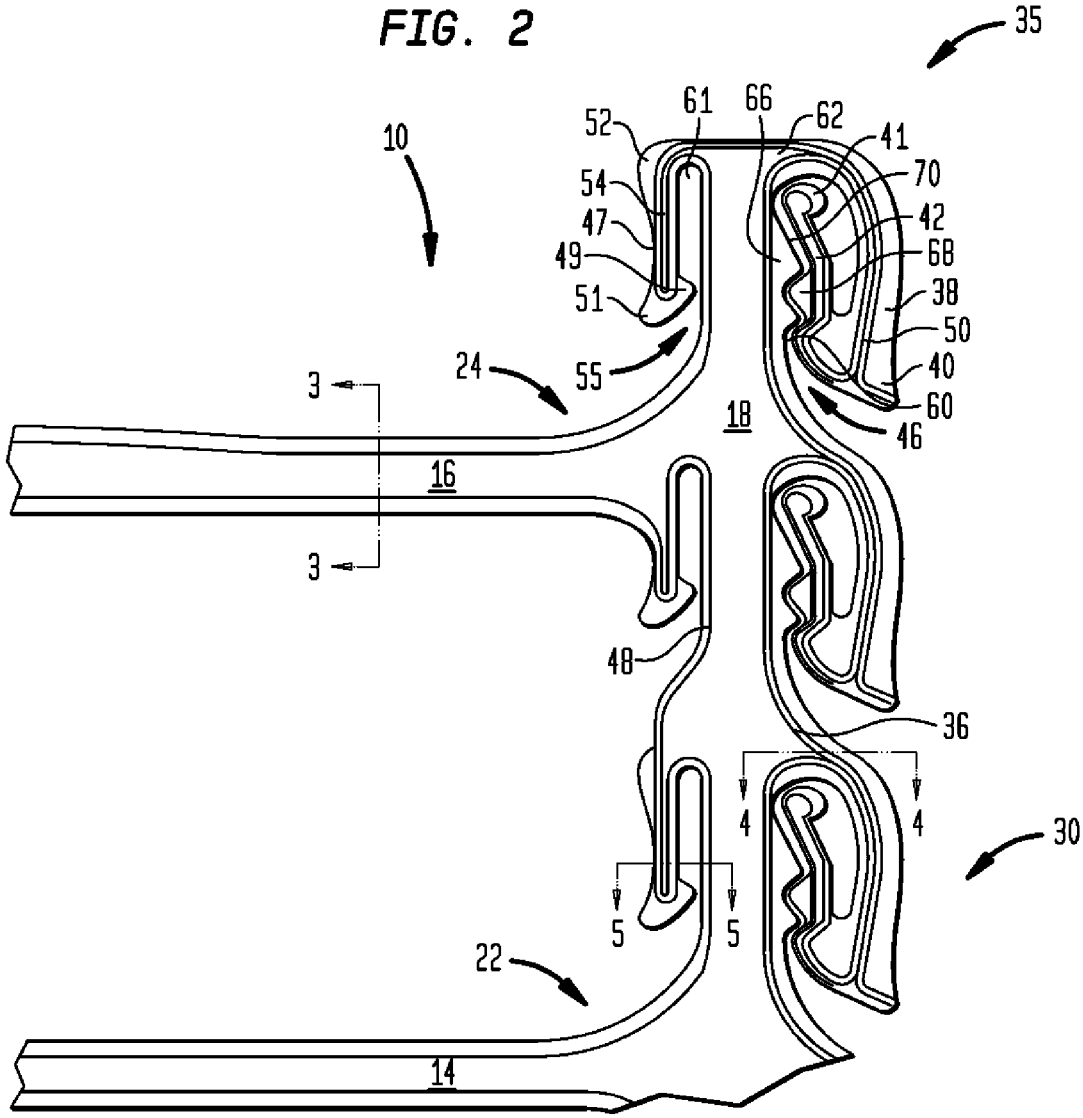
FIG. 2 is an enlarged view of one end of the molded plastic garment hanger of FIG. 1, illustrating further details of the novel features and construction thereof.

Referring now in detail to the drawings, FIGS. 1 and 2 illustrate a front view of a molded plastic garment hanger (hereinafter, "hanger") 10 having a hook member 12 and a pair of elongated body members 14 and 16, at least one of which, such as elongate body members 16, is connected to the hook member 12. However, it should be understood that the hanger 10 may include three or more elongated body members depending on the application circumstances of the hanger. Each elongated body member 14, 16 is connected to and integrally molded with a pair of generally parallel vertical members 18. As shown, the vertical members 18 are substantially perpendicular to each elongated body member 14, 16 and connected respectively at first ends 22, 24 and opposite second ends 23, 27 of each elongated body member 14, 16.

In the shown embodiment, a plurality of stacked vertical garment retaining clips 30 are disposed outwardly from an inner surface 48 and an outer surface 36 of the vertical members 18 for securing a series of garments. The particular illustrated shapes of the hook member 12 and the plurality of elongated body members 14, 16 are exemplary only, and may vary in number and shape.

As depicted best in FIG. 2, the hanger 10 includes a first vertical garment retaining clip 35 disposed outwardly from the outer surface 36 of the vertical member 18. The first vertical garment retaining clip 35 includes a first support member 38 extending substantially downwardly and vertically, and a first cantilever mount 40 connecting the first support member 38 to a second support member 42. The second support member 42 substantially extends upwardly and inwardly from the first cantilever mount 40. Also, the second support member 42 extends from the first support member 38 in a direction that is vertically opposed from the cantilever mount 40. Accordingly, a first mouth 46 is defined by the second support member 42 and the vertical member 18, which guides a garment (not shown) into the first vertical garment retaining clip 35. The first vertical garment retaining clip 35 further includes a second cantilever mount 62 connecting the first support member 38 to the vertical member 18. The second cantilever mount 62 has the same thickness as the vertical member 18 to permit some flexure between the second cantilever mount 62 and the vertical member 18.

As also shown in FIG. 2, hanger 10 further includes a second vertical garment retaining clip 45 disposed outwardly from the inner surface 48 of the vertical member 18. In the shown embodiment, the second vertical garment retaining clip 45 includes an inner support member 47 extending substantially downwardly and vertically, and a third cantilever mount 52 connecting the inner support member 47 to the vertical member 18. Accordingly, a second mouth 55 is defined by the inner support member 47 and the vertical member 18, which guides a garment strap (not shown) into the second vertical garment retaining clip 45.

FIGS. 1-2 also illustrate a first stiffening rib 50 disposed along the first and second support members 38, 42. The first stiffening rib 50 stiffens the cantilever mounting, and resists movement of the first and second support members 38, 42 into and out of the plane of the hanger 10.

Similarly, a second stiffening rib 54 is disposed along the inner support member 47. The second stiffening rib 54 stiffens the connection between the inner support member 47 and the vertical member 18, and resists movement of the inner support member 47 into and out of the plane of the hanger 10.

The construction and design are such that as a garment or strap is initially inserted into the mouth 46 of the first garment receiving channel 60, the combination of the first and second support members 38, 42 rotates about the second cantilever mount 62. During initial insertion of the garment, the first support member 38 bends outwardly, with the outward motion most pronounced near the first cantilever mount 40. As the garment slides past the first cantilever mount 40 and towards the free end 41 of the second member 42, it causes an outward flexure of the free end 41 of the second member 42. This results in an inward deflection of the first support member 38 near the first cantilever mount 40 and a closing of the bottom of the first vertical garment retaining clip 35 near the mouth 46.

As best shown in FIG. 2, hanger 10 further includes a first toothed section 66 disposed along the outer surface 36 of vertical member 18 and a second toothed section 68 disposed along an edge 70 of the second support member 42. The first toothed section 66 and the second toothed section 68 oppose each other to form the first garment receiving channel 60 that grasps and retains the garment. Accordingly, as a garment is inserted into the first vertical garment retaining clip 35, the compound movement of the first and second support members 38, 42 results in the mouth 46 of the clip first opening to allow the garment to enter, and then closing to securely retain the garment.

Figure 3:
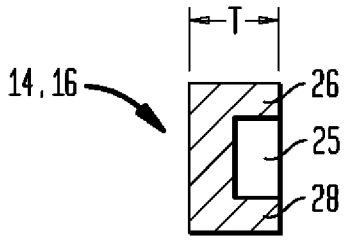
FIG. 3 is an enlarged sectional view, taken along sectional arrows 1-1 in FIG. 2, and illustrates further details of construction of the elongated body members.
Figure 4:
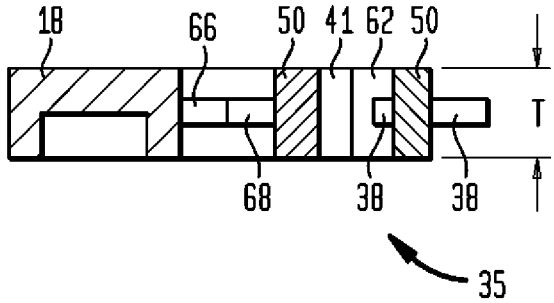
FIG. 4 is an enlarged sectional view, taken along sectional arrows 2-2 in FIG. 2, and illustrates further details of construction of the vertical member and the first vertical garment retaining clip.
Figure 5:
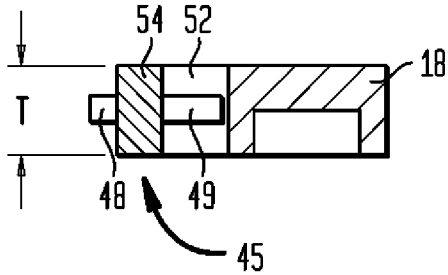
FIG. 5 is an enlarged sectional view, taken along sectional arrows 3-3 in FIG. 2, and illustrates further details of construction of the vertical member and the second vertical garment retaining clip.

Furthermore, as best shown in FIGS. 3-5, the first and second vertical garment retaining clips 35, 45 are both constructed to have the same thickness as the elongated body members 14, 16 and the vertical members 18 in order to resist movement of the first and second vertical garment retaining clips 35, 45 into and out of the plane of the hanger body. To maximize strength while using the minimum amount of material, the elongated body members 14, 16 and the hook member 12 are constructed with a C-shaped cross section having a central web member 25 and a plurality of flange members 26, 28, the flange members defining a top flange member 26 and bottom flange member 28 at opposing vertical ends. Furthermore, the flange members 26, 28 are horizontally disposed along the length of each elongated body member 14, 16. However, in alternative embodiments the elongated body members 14, 16 may be constructed with a curved M-shaped cross-section, an E-shaped cross-section, an I-beam cross-section, or any suitable cross-section which may improve the strength to weight ratio for particular applications to resist flexing due to the weight of the garment hanging from the hanger 10 of the present invention and to assist in maintaining the hanger upright when in use.

Specifically, FIG. 4 shows an enlarged sectional view, taken along sectional arrows 2-2 in FIG. 2, and illustrates further details of construction of the vertical members 18 and the first vertical garment retaining clip 35. As shown, the overall thickness (T) of the first vertical garment retaining clip 35 is the same as the vertical members 18 and each elongated body member 14, 16. However, the first support member, the first toothed section 66 and the second toothed section 68 have a reduced thickness. Similarly, FIG. 5 is an enlarged sectional view, taken along sectional arrows 3-3 in FIG. 2, and illustrates further details of construction of the vertical members 18 in connection with the second vertical garment retaining clip 45. The overall thickness (T) of the second vertical garment retaining clip 45 is the same as the vertical members 18, while the inner support member 48 and the tooth 49 of the inner support member 48 have a reduced thickness.

With such hangers, garments are frequently inserted into the garment clips manually by a worker who inserts a great number of garments into corresponding garment clips. Prior art multiple garment hangers that include garment clips to conceal garment straps typically have two clips or a double clip located adjacent the outer surface of the vertical member. However, it is difficult for workers to quickly and accurately load the garment and garment straps into their respective clips with this prior art configuration. In contrast, with the hanger 10 shown in FIGS. 1 and 2, for example, a worker can easily insert the garment into the first garment receiving channel 60, wrap the garment strap around the vertical member 18, and secure the garment strap with the second vertical garment clip 45. As such, the garment straps are concealed behind the securely fastened garment.

The inventive plastic hanger can be formed of styrene which provides a clear, virtually transparent polystyrene hanger for maximum display of intimate apparel garments, such as bras and panties, to be suspended therefrom. Alternatively, the hanger can be molded from polypropylene, styrene polypropylene, polypropylene, polyvinychloride, ABS or other suitable thermoplastics and mixtures thereof. For additional reinforcement, K resin can be added to the plastic material. The preferred material, polystyrene, has a Flexural Modulus, MPa, of 3,170, taken from CONCISE ENCYCLOPEDIA OF POLYMER SCIENCE AND ENGINEERING, p. 1117.

Referring again to FIGS. 1 and 2, the first and second vertical garment retaining clips 35, 45 are integrally molded with the vertical member 18. Furthermore, as shown, the second vertical retaining clip 45 is disposed closer to the hook member 12 than the first vertical retaining clip 35. The first vertical garment retaining clip 35 is designed to mount a garment, while the second vertical garment retaining clip 45 is designed to secure the garment straps. The first vertical garment retaining clip includes a mouth 46 at the bottom of the garment receiving channel 60 that is relatively large, thus making it easier to mount panties on the hanger 10.

As discussed above, and as best shown in FIG. 2, the first vertical garment retaining clip 35 includes the first downwardly extending support member 38 mounted to the vertical member 18 and connected to the second support member 42 by the first cantilever mount 40. The second support member 42 is positioned opposed to and spaced from the vertical member 18. The second support member 42 defines a second toothed section 68 spaced and opposed to the first toothed section 66, to form the garment receiving channel 60 therebetween to grasp and retain a garment therein.

A further feature of the first vertical garment retaining clip 35 is the inward slant defined by the first garment receiving channel 60. For example, as a garment waist band is inserted into the first vertical garment retaining clip 35 and is inserted from an initial bottom position to a fully inserted position near the second cantilever mount 62, the garment waist band moves inwardly towards the center of the hanger 10 at a distance of approximately ⅛ inch. This means that after a garment waist band is inserted fully into the first vertical garment retaining clip 35, the garment waist band shrinks approximately ⅛ inch at each end of the hanger 10. This also means that the garment waist band must be expanded or stretched ¼ inch, ⅛ inch at each end of the hanger 10, to remove the garment from the first vertical garment retaining clip 35. This makes accidental removal or dislodgement of the garment from the first vertical garment retaining clip 35 unlikely.

The second vertical garment retaining clip 45 includes the inner support member 48 mounted to the vertical member 18 by the third cantilever mount 52. The inner support member 47 is positioned opposed to and spaced from the vertical member 18 to define a second garment receiving channel 61 therebetween. Inner support member 47 includes a tooth 49 on the free end 51 of inner support member 47. Although only a single tooth 49 is shown in this embodiment, it can be appreciated that the number of teeth can vary without departing from the scope of the invention. The construction of the inner support member 47, including the second stiffening rib 54, provides a relatively inflexible mount for the strap of a garment.

Furthermore, as shown in FIG. 1, depending on the placement of the elongated body members 14, 16, the second vertical garment receiving clip 45 is integrally molded with the elongated body members 14, 16 and the pair of vertical members 18 at first ends 22, 24 and second ends 23, 27 of the elongated body members 14, 16. However, as also shown, a number of vertical garment retaining clips are integrally molded with the vertical members 18 only. However, it can be appreciated that the number and placement of elongated body members 14, 16 can vary without departing from the scope of the invention.

Thus, while there have shown and described and pointed out fundamental novel features of the invention as applied to various specific embodiments thereof it will be understood that various omissions and substitutions and changes in the form and details of the hanger illustrated may be made by those skilled in the art without departing from the spirit of the invention. Moreover, it should be recognized that structures shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A molded plastic garment hanger comprising:

a hook member, the hook member being substantially vertically disposed;

a first elongated body member and a second elongated body member, the first and second elongated body members substantially horizontally disposed;

a pair of substantially parallel vertical members vertically disposed and integral to the first and second elongated body members, the vertical members being substantially perpendicular to each elongated body member and connected with a first end and a second end of each elongated body member;

a first plurality of vertical garment retaining clips extending from an outer surface of each vertical member, each of the first plurality of vertical garment retaining clips comprising:

a first support member connected to the vertical member;

a first cantilever mount connecting the first support member to a second support member;

a second cantilever mount connecting the first support member to the vertical member; and a first mouth defined by the second support member and the vertical member, for guiding a garment into the first vertical garment retaining clip; and a second plurality of vertical garment retaining clips extending from an inner surface of each vertical member towards the hook member, each of the second plurality of vertical garment retaining clips comprising:

an inner support member connected to the vertical member;

a third cantilever mount connecting the inner support member to the vertical member; and a second mouth defined by the inner support member and the vertical member, for guiding a garment strap into the second vertical garment retaining clip.

2. The hanger of claim 1, wherein each elongated body member comprises a C-shaped cross section having a central web member, a top flange member and a bottom flange member at opposing vertical ends of the web member, the flange members horizontally disposed along the length of each elongated body member.

3. The hanger of claim 1, wherein the second vertical garment retaining clips are disposed closer to the hook member than the first vertical garment retaining clips.

4. The hanger of claim 1, wherein the first and second vertical garment retaining clips are integrally molded with each vertical member.

5. The hanger of claim 1, further comprising a first stiffening rib disposed along the first and second support members.

6. The hanger of claim 5, further comprising a second stiffening rib disposed along the inner support member.

7. The hanger of claim 1, further comprising a first toothed section disposed along the outer surface of the vertical member and a second toothed section disposed along an edge of the second support member, wherein the first toothed section and the second toothed section oppose each other to form a garment receiving channel that grasps and retains the garment.

* * * * *